US009908763B2

(12) United States Patent
Bagge

(10) Patent No.: US 9,908,763 B2
(45) Date of Patent: Mar. 6, 2018

(54) ADJUSTMENT HEAD FOR A HOISTING DEVICE

(75) Inventor: Niels Henrik Bagge, Slagelse (DK)

(73) Assignee: HH INTELLITECH APS, Farsoe (DK)

( * ) Notice: Subject to any disclaimer, the term of this patent is extended or adjusted under 35 U.S.C. 154(b) by 0 days.

(21) Appl. No.: 13/502,786

(22) PCT Filed: Oct. 21, 2009

(86) PCT No.: PCT/IB2009/054664

§ 371 (c)(1),
(2), (4) Date: Sep. 19, 2012

(87) PCT Pub. No.: WO2011/048441

PCT Pub. Date: Apr. 28, 2011

(65) Prior Publication Data

US 2013/0004265 A1 Jan. 3, 2013

(51) Int. Cl.

| | |
|---|---|
| ***B66F 9/18*** | (2006.01) |
| ***B66F 9/065*** | (2006.01) |
| ***B66F 9/075*** | (2006.01) |
| ***B66F 9/14*** | (2006.01) |

(52) U.S. Cl.

CPC ..... *B66F 9/181* (2013.01); *B66F 9/0655* (2013.01); *B66F 9/07581* (2013.01); *B66F 9/147* (2013.01)

(58) Field of Classification Search

CPC ..... E04F 21/1872; E04F 21/18; E04G 21/18; B66C 1/02; B66C 23/00; B66C 23/04; B66C 23/30; B66F 9/181; B66F 9/0655; B66F 9/07581; B66F 9/147

USPC ..... 414/10–12, 743, 666; 901/22, 28, 31, 40

See application file for complete search history.

(56) References Cited

U.S. PATENT DOCUMENTS

| | | | | |
|---|---|---|---|---|
| 1,606,101 | A * | 11/1926 | Russell | 414/11 |
| 3,598,263 | A * | 8/1971 | Ehmke | 414/620 |
| 3,630,389 | A * | 12/1971 | Schmidt et al. | 414/4 |
| 3,672,521 | A | 6/1972 | Bauer et al. | |
| 3,802,150 | A * | 4/1974 | Melton et al. | 52/749.15 |
| 4,280,785 | A * | 7/1981 | Albrecht | 414/735 |
| 4,696,613 | A * | 9/1987 | Hahn | 414/11 |
| 4,899,637 | A * | 2/1990 | Caruso | 91/173 |
| 5,259,721 | A * | 11/1993 | Sato et al. | 414/620 |
| 5,433,818 | A * | 7/1995 | Lee | 156/576 |

(Continued)

FOREIGN PATENT DOCUMENTS

| | | |
|---|---|---|
| DE | 92 02997 | 7/1993 |
| DE | 93 09 889 | 11/1994 |

(Continued)

OTHER PUBLICATIONS

International Search Report for PCT/IB2009/054664.

(Continued)

*Primary Examiner* — Anna M Momper
*Assistant Examiner* — Lynn E Schwenning
(74) *Attorney, Agent, or Firm* — Marvin Petry; Stites & Harbison, PLLC

(57) ABSTRACT

An adjustment head (2) is provided for a hoisting device (1) and intended for releasable connection (7) with the free end (6) of the hoisting device (1), said adjustment head (2) comprising mechanisms (9-13, 15) for three-dimensional adjustment of the adjustment head (2) independently from adjustment means of the hoisting device (1).

17 Claims, 4 Drawing Sheets

(56) References Cited

U.S. PATENT DOCUMENTS

| | | | | | |
|---|---|---|---|---|---|
| 5,516,254 | A * | 5/1996 | Gessler | ..... | 414/607 |
| 5,584,646 | A * | 12/1996 | Lewis et al. | ..... | 414/738 |
| 7,600,959 | B2 * | 10/2009 | Neubauer et al. | ..... | 414/11 |
| 2007/0189882 | A1 * | 8/2007 | Smith et al. | ..... | 414/340 |
| 2008/0163403 | A1 * | 7/2008 | Tominaga | ..... | 901/2 |
| 2011/0264306 | A1 * | 10/2011 | Bagge | ..... | 701/2 |

FOREIGN PATENT DOCUMENTS

| | | | | | |
|---|---|---|---|---|---|
| EP | 0 393 004 | | 10/1990 | | |
| WO | WO9919583 | * | 4/1999 | ..... | E04G 21/16 |

OTHER PUBLICATIONS

Written Opinion of the International Searching Authority for PCT/IB2009/054664.

International Preliminary Report on Patentability for PCT/IB2009/054664.

* cited by examiner

ADJUSTMENT HEAD FOR A HOISTING DEVICE

FIELD OF THE INVENTION

The present invention relates to an adjustment head for a hoisting device, wherein the adjustment head could be releasably attached to a vehicle-supported as well as a stationary hoisting device to be used for mounting an element in an opening in a structure.

BACKGROUND OF THE INVENTION

In the field of hoisting devices to be used for hoisting and mounting building elements; especially glazing panels, it is common practice to use a telehandler equipped with a vacuum gripper rack to grip and hoist a panel to be mounted in a wall or vehicle body and then fit it into its final position.

There are custom-built glass lifters available for short-range operations and for long-range operations, and for a number of reasons there also exists glass hoisting attachments to be suspended from a crane outrigger or to be mounted on a front end loader replacing e.g. a forklift attachment or bucket attachment.

Already in the 1960's a de facto standard for mounting means on many loaders was established by the Bobcat Company with their Bob-Tach® system (U.S. Pat. No. 3,672,521 Bauer et al.). The industry developed attachments or implements cooperating with said standardized system, thereby opening a door to a huge market of existing and future loaders ready to accept the standardized implements.

The actual problem dealt with in this invention is that the machinery used to hoist heavy glazing panels often is not able to bring the panels all the way into the waiting openings without an operator having to manually maneuver heavy panels the last distance. Such hard work would often be challenged by occupational health regulations.

US patent application no. 2007/0189882 A1 (Smith et al.) describes an attachment for a telescopic material handler for manipulating a load. The attachment includes a gripping system and a manipulation assembly.

An essential task to be solved, when heavy glazing panels are hoisted to a site at a high level above ground, is that the delicate maneuvering of the gripper rack carrying a panel during the final stages of positioning and mounting said panel requires a higher precision and control of movements than offered by a gripper assembly operated by a fully extended crane or boom, and consequently an adjustment head to be used with any standard hoist device but functionally independent therefrom and having a high degree of precision control of the gripping rack is the aim of the invention.

The said US application does provide many degrees of freedom, but a missing vital degree is to extend the reach of the implement, after a correct alignment is secured. Moreover, it is important that the implement is self-contained and only needs power from an external source to be a separate fully functional implement and not relying on external hydraulic sources.

A further disadvantage with said US application is that some incremental adjustments result in too large movements.

Accordingly, it has been important to consider a solution wherein at least some of the incremental adjustments result in shorter distances moved. An advantageous way of obtaining this comes from arranging the pivot points as close as possible to the panels to be mounted.

SUMMARY OF THE INVENTION

The present invention suggests an adjustment head for a hoisting device and adapted for releasable connection with a free end of the hoisting device, said adjustment head comprises a mechanism for three-dimensional adjustment of the adjustment head independently from adjustment means belonging to the hoisting device. The adjustment head is self-contained and comprises a mechanism providing extension and tilting in a vertical plane by means of an extendable arm and a linkage and piston means. The extendable arm would in a preferred embodiment be a telescopic boom. The linkage consists of a number of bars operated by a hydraulic cylinder and piston fixed to the extendable arm. Moreover, the head comprises actuators providing rotation around each axis thereof; said axes being oriented perpendicular to each other. The linkage is connected to the actuators for them to tilt in a vertical plane. The head further comprises a lateral sliding mechanism, e.g. a gear rack providing a sliding movement of the head perpendicular to the axial direction thereof; and comprises a service box with a complete set of control and drive means for all moving parts of said head, said sliding movement being provided by push or pull from hydraulic elements, e.g. cylinders, or wires.

The adjustment head according to the invention has an attached gripper structure to grip an element or panel and place said element in a required position relative to a structure such as a building or a vehicle.

In an advantageous embodiment of the invention the tilt mechanism, the extendable mechanism and the sliding mechanism are arranged on a releasable connection console attached to a corresponding console at the free end of a hoisting device. Said connection consoles have a standardized layout permitting a wide range of implements to be attached.

One of the actuators mentioned above is connected to the extension and tilt mechanisms and the other actuator is connected to the gripper structure. Said gripper structure includes gripper heads using e.g. a vacuum source or a magnetic source contained in the service box to hold an element or panel.

Preferred embodiments show that in order to obtain a very compact configuration the actuators of the adjustment head are combined in one unit, and to obtain small incremental adjustments the tilting mechanism and the actuator unit are arranged closer to the gripper structure than to the connection console.

In order to facilitate operation from remote hold the adjustment head could be operated by control means in the service box and activated by a separate remote control.

Moreover, the invention suggests a method of hoisting and mounting an element in a fitting opening in a structure, comprising a first stage, wherein the element is gripped by a gripper rack from an optional position and hoisted to a site at the required level in proximity to the final position; and a second stage wherein the position of the element is spatially adjusted by means of an adjustment head according to the invention and controlled by control means in the service box, whereby the element finally fits into an opening in a structure, and the adjustment head releases the element.

The adjusting head according to the invention has a big potential because it can be applied to almost any hoisting device available in the market, as long as it has standardized mounting means. The hoisting device makes for the "gross motor control" motions bringing the hoisted element next to the final destination, while the adjusting head accounts for the fine tuning or "fine motor control" motions necessary for the final alignment of the element to the corresponding opening. The minor final movements to be performed imply finer incremental adjustments and thereby higher precision of the adjustment means.

Accordingly, much physical and hazardous work hitherto performed by personnel is avoided, and the mounting can be carried out in shorter time. Furthermore, a hoisting device adapted to have attached any standardized implement, would be used more extensively during working hours if an adjustable head according to the invention is available.

Building elements to be picked up and mounted in a structure like a building or a vehicle could comprise glass panels, concrete, steel or metal panels or wooden boards as long as the surface thereof can be sucked onto by vacuum cups or can be contacted by magnetic cups or the like.

BRIEF DESCRIPTION OF THE DRAWINGS

The invention will be described in further details below with reference to the drawings, wherein.

DETAILED DESCRIPTION OF THE INVENTION

Figure 1:
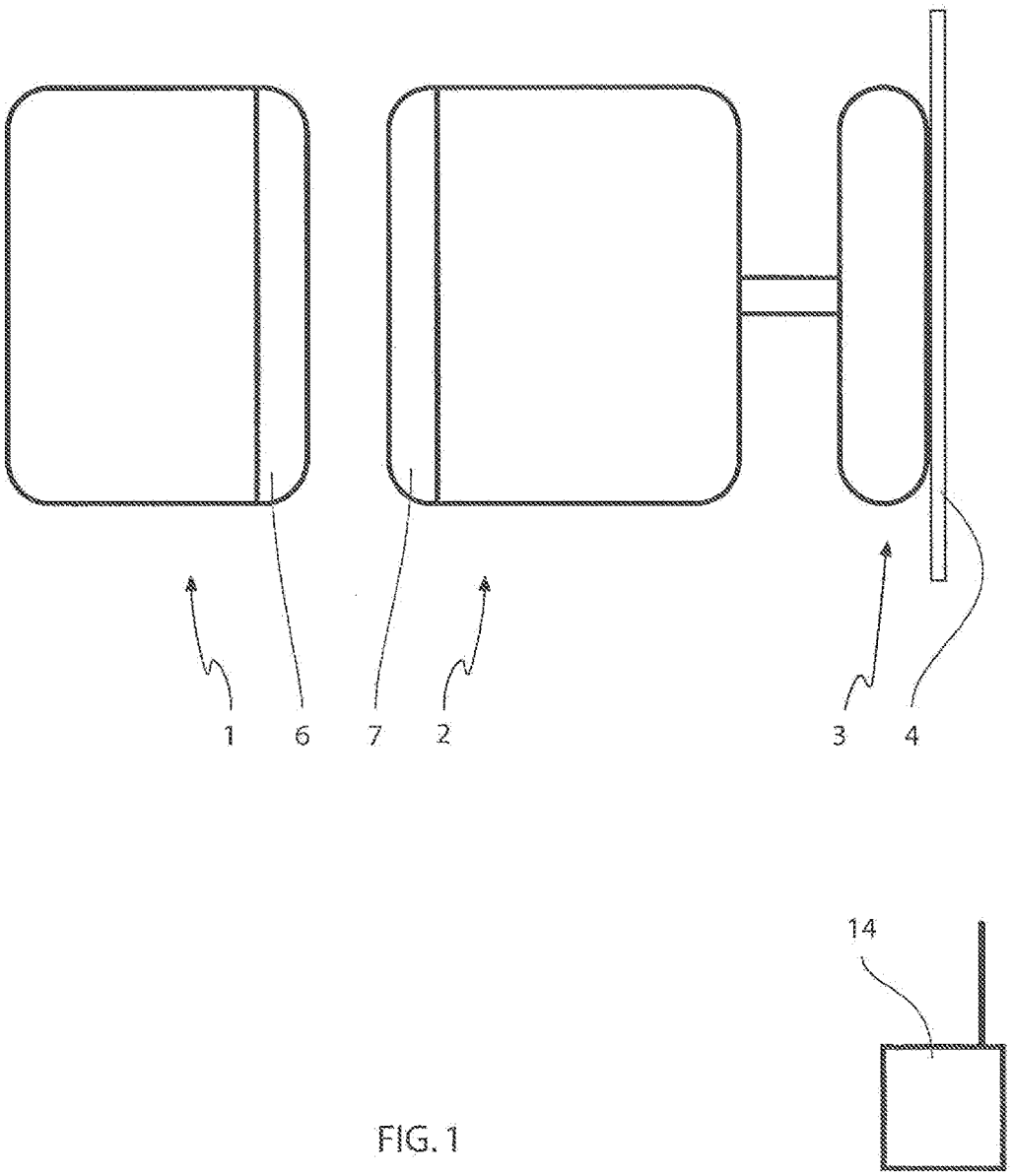
FIG. 1 is a block diagram of the main components of a hoisting arrangement having an adjustment head according to the invention.

In FIG. 1 a block diagram shows the main components of a hoist arrangement comprising a standard hoisting device 1 and an adjusting head 2 comprising the required components for fine-adjusting the position of a building panel hoisted to near its planned position, and a gripper unit 3 to retain a building panel to be mounted in a structure. The hoisting device 1 could be any type of a loader or a telehandler capable of carrying an adjustment head implement 2 with a co-operating gripper rack 3 retaining a building panel 4 by means of vacuum cups 5 (see also FIG. 2). The head 2 and rack 3 being controlled by a separate remote control 14.

Figure 3:
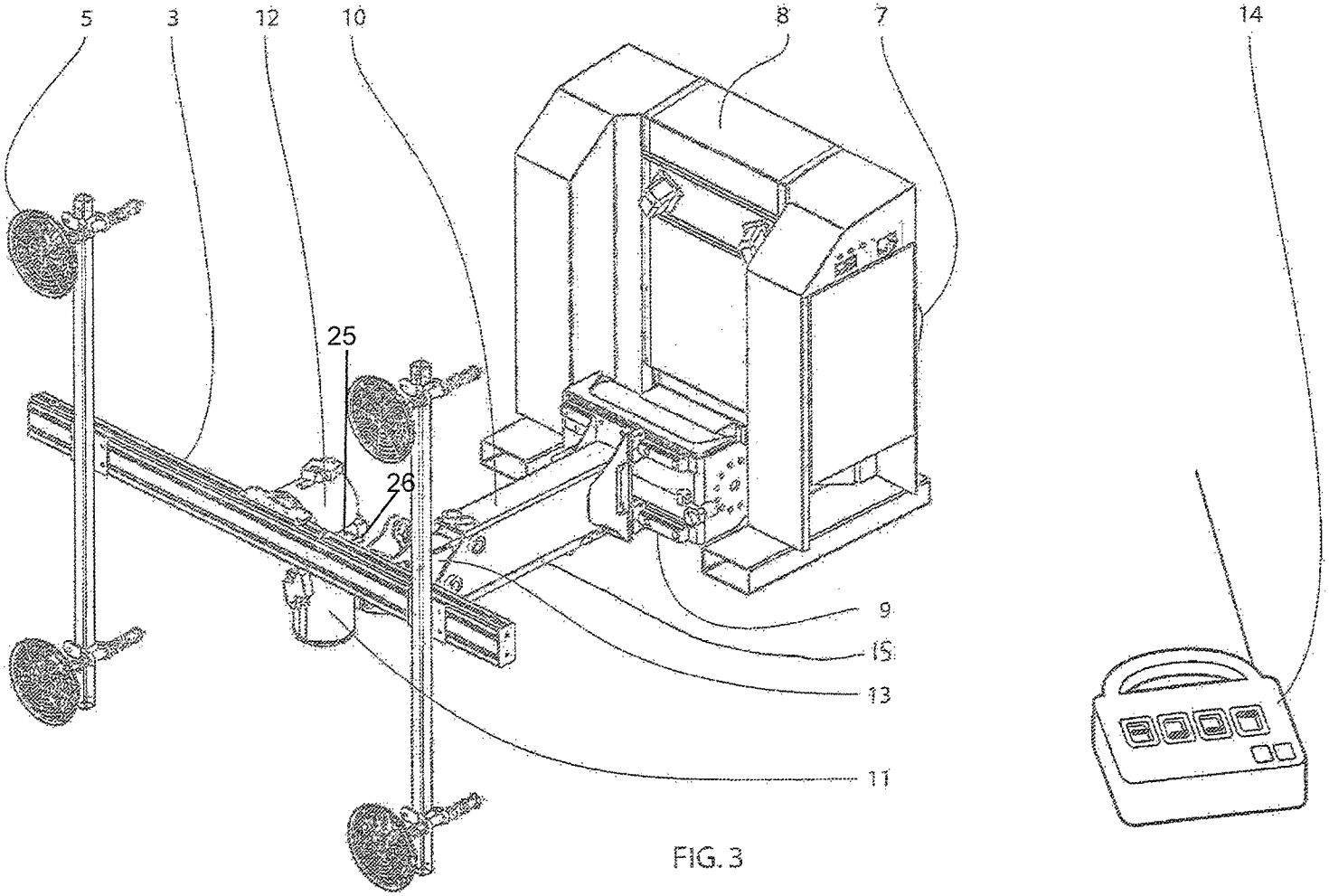
FIG. 3 is a perspective view of the adjustment head according to the invention.

Referring also to FIG. 3 a suitable telehandler 1 would be equipped with a connection console 6 matching a corresponding connection console 7 of the adjustment head 2 and shown in greater details, said head further comprising a service box 8 united with the connection console 7 and containing e.g. hydraulic means, vacuum means, control means and drive means to be used for operating the adjustment head 2 and gripper rack 3. On the surface of the service box 8 is arranged a gear rack 9 along which an extendable boom 10 can slide laterally to its own axis in order to adjust for lateral misalignment of the building panel 4 relative to a wall opening.

Figure 4:
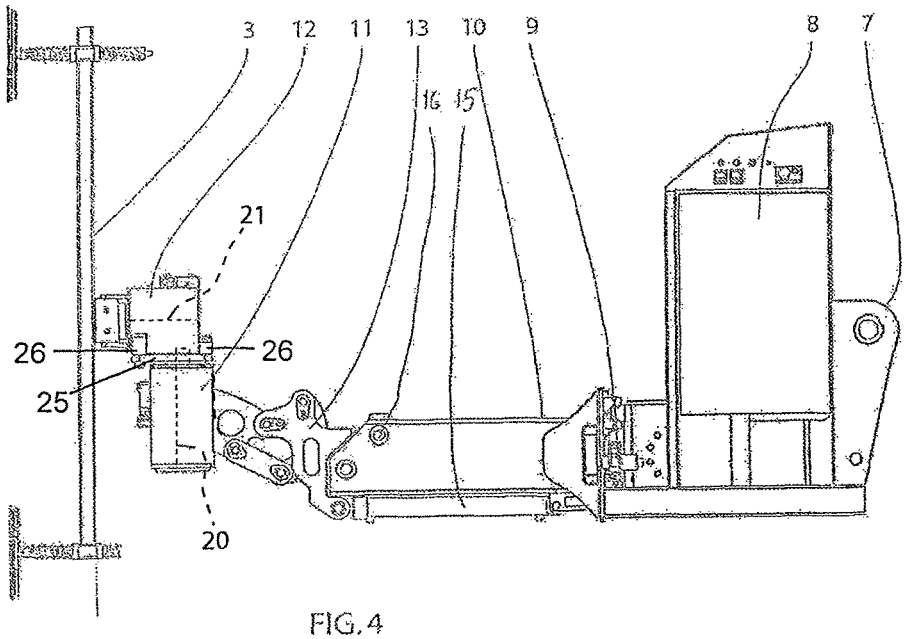
FIG. 4 is a side view of the adjustment head in FIG. 3.

At the free end of the extendable boom 10 is arranged a combination of actuators 11, 12 comprising a first actuator 11 and a second actuator 12 in a unitary configuration, which, as shown in FIGS. 3 and 4, comprises a plate 25 and elements 26 which attach the shaft of the first actuator to the body of the second actuator, and wherein the first actuator 11 has a first shaft which defines a first axis shown schematically at 20 and the second actuator 12 has a second shaft which defines a second axis shown schematically at 21; said first axis and second axis being oriented perpendicular to each other and the first actuator being connected to the free end of the extendable boom 10 via a tilt linkage 13 tilting the actuator 11 in a vertical plane by means of the piston of a hydraulic cylinder 15. The linkage 13 rotates around a pivot point 16. Said second actuator 12 is rotated in a plane perpendicular to the first shaft and swivels the rack 3 around the second shaft.

The adjustment head 2 is preferably configured to be operated by a separate remote control 14. However, it is possible to have an ordinary control panel connected to the head 2, if so desired, or to have both.

FIG. 4 shows a side view of the adjustment head, wherein the service box 8 appears next to the gear rack 9 and its drive means and having its connection console 7 ready to be coupled to a standardized interface of a connection console on a telehandler. Further the extendable boom 10 is adapted to slide along the gear rack 9 and to extend away from said rack. At the free end of the boom 10 is installed a tilt linkage 13 allowing—in the paper plane—vertical tilting of the first actuator 11 being connected thereto and swinging the second actuator 12 in and out of the paper plane. Moreover, the gripper rack 3 being in this embodiment of the invention provided with vacuum cups 5 can be swiveled by the shaft of the second actuator 12.

Figure 5:
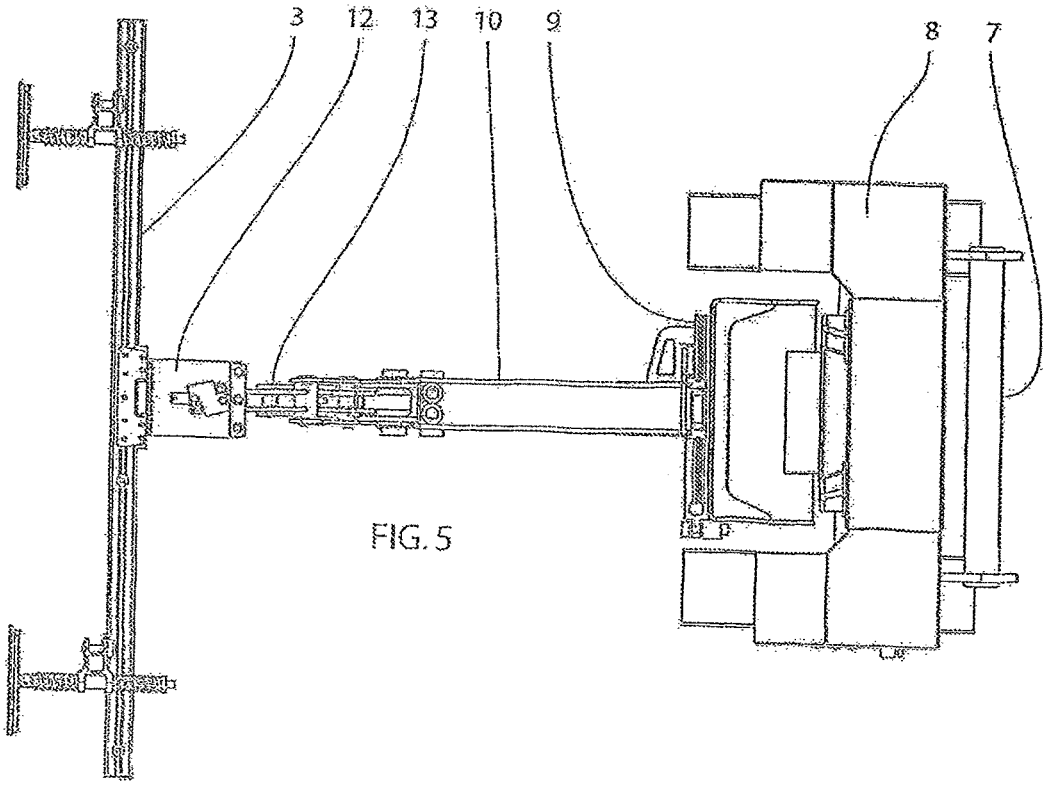
FIG. 5 is a plan view of the adjustment head in FIG. 3.

FIG. 5 further illustrates a horizontal orientation of the actuator 12 in a plan view and being rotated in the paper plane while the same actuator is able to swivel the rack 3 in and out of the paper plane.

Figure 2:
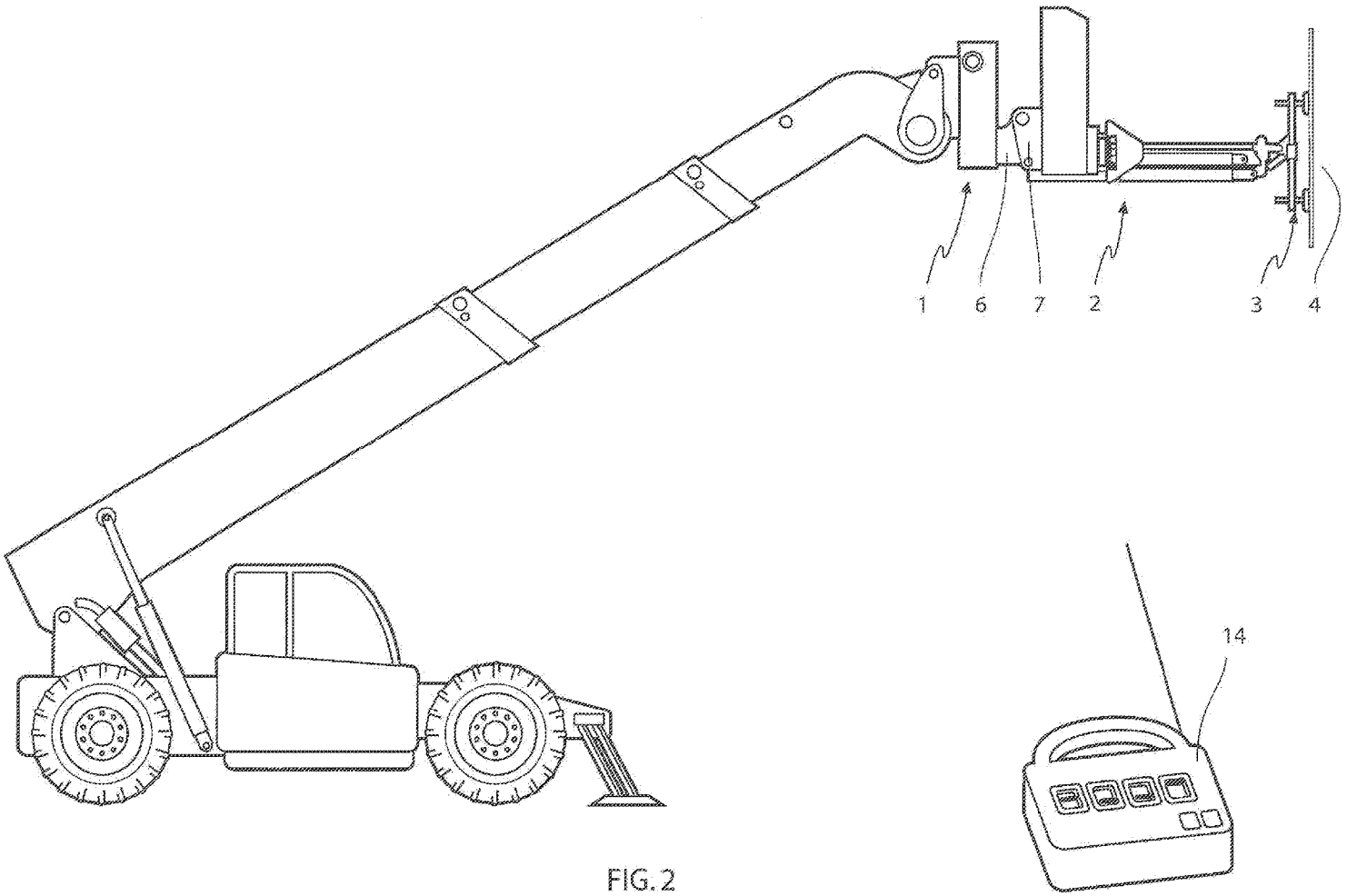
FIG. 2 shows the adjustment head according to the invention, mounted on a standard telehandler.

In a working situation a loader 1 having a standardized connection console 6 approaches an adjustment head 2 having a corresponding standardized connection console 7, and said consoles 6, 7 connect securely to each other (FIG. 2). Next, the operator picks up a building panel 4 from the ground or other storage area by the vacuum cups 5 of a gripper rack 3 connected to the actuator 12. When the panel 4 is adjusted to an appropriate position it is hoisted to near the mounting site, bringing the initial "gross control motor" stage to an end. Thereafter, the second "fine control motor" stage is initiated by the adjustment head making the precision movements of the retained panel 4 in order to bring the panel 4 in precise alignment with a corresponding opening by tilting the rack to a vertical plane and horizontally swinging the rack until said plane is in parallel with the surface of a building or a vehicle to be furnished with the panel 4 and finally extending the boom 10 forward simultaneously mounting the panel 4 in the opening. The sequence in which said movements are performed is not vital to the method and can be repeated in order to obtain very precise alignment with no physical manipulation by a human being.

All maneuvering is preferably controlled by means of a separate remote control 14; either from a convenient position on the ground or from a vantage point close to the opening.

In the description of the adjustment head and the method, vacuum is the means used for gripping and retaining a panel, but of course also other gripper means like magnetic means could be used according to the material characteristics of the panel.

The panels to be hoisted and mounted could be any panel of optional material, e.g. glass, gypsum, rock, concrete, iron, metal or fiberboard.

The invention claimed is:

1. A self-contained adjustment head comprising a releasable connection to the free end of a hoisting device, the adjustment head comprising mechanisms for adjustment of the adjustment head, comprising:

a boom linearly extendable and retractable along its longitudinal axis, a tilting linkage connected to the end of the boom, a first rotary actuator connected to the tilting linkage, the first rotary actuator having a housing, and the tilting linkage engaging the housing to tilt the first actuator in a vertical plane between an upright position and a tilted position, the first rotary actuator having a first shaft which rotates about a vertical axis when the first rotary actuator is in its upright position, and which remains in the vertical plane during tilting of the first actuator, a second rotary actuator having a housing including a second shaft, the axis of which second shaft is perpendicular to the axis of the first shaft, the housing of the second rotary actuator operatively engaged with the first shaft to rotate in said vertical plane about the axis of the first shaft upon rotation of the first shaft, the second shaft having an engagement structure at an end thereof which connects to an object, such that when the second shaft rotates, it rotates the object in a plane perpendicular to the axis of the second shaft, and wherein an object connected to the second shaft is subjected to al four of tilting by movement of the tilting linkage, rotation in a plane perpendicular to the axis of the first shaft by rotation of the first shaft, rotation in a plane perpendicular to the axis of the second shaft by rotation of the second shaft, and linear displacement along the longitudinal axis of the boom.

2. The adjustment head according to claim 1, including a piston and cylinder fixedly connected at one end relative to the hoisting device and connected at its other end to the tilting linkage.

3. The adjustment head according to claim 2, including a service box with controls and drives for driving the piston and the actuators.

4. The adjustment head according to claim 1, including a gripper structure connected to the second shaft and which can grip a panel to place the panel into a required position relative to a structure.

5. The adjustment head according to claim 1, wherein the adjustment head is connected by a releasable connection to a corresponding console at the free end of the hoisting device.

6. The adjustment head according to claim 5, wherein the console has a standardized layout permitting a wide range of implements to be attached hereto.

7. The adjustment head according to claim 1, wherein the object is a gripper structure which includes a gripper head having a vacuum source or a magnetic source to hold a panel.

8. The adjustment head according to claim 1, including a service box with a control and drive structure for driving the two actuators and the control device is controlled by a remote controller.

9. The adjustment head according to claim 1, wherein the boom has a telescopic construction to permit such movement in the longitudinal direction.

10. The adjustment head according to claim 1, the boom being mounted to undergo linear movement transverse to the longitudinal direction of the boom.

11. The adjustment head according to claim 10, wherein the mounting of the boom to undergo transverse movement comprises a gear rack.

12. The adjustment head according to claim 1, including a gripper structure which is connected to the second shaft and undergoes movement in all three dimensions, the gripper structure including a gripper head for holding a panel.

13. The adjustment head according to claim 12, the gripper head comprising vacuum cups.

14. The adjustment head according to claim 12, wherein the gripper head is a magnet.

15. A method of hoisting and mounting an object to a predetermined position relative to a structure, comprising the steps of:

moving a boom linearly along its longitudinal axis to expand and retract the boom, tilting a tilting linkage which is connected to one end of the boom in a vertical plane, the tilting linkage connected to a housing of a first rotary actuator and tilting of the tilting linkage in the vertical plane tilts the housing in the vertical plane, providing the first rotary actuator with a first shaft which also moves in the vertical plane upon tilting of the first rotary actuator, providing a second rotary actuator having a housing operatively engaged with the first shaft, such that rotation of the first shaft rotates the housing of the second actuator, the second rotary actuator having a shaft with its axis perpendicular to the axis of the first shaft, and connecting an object to the second shaft, such that rotation of the second shaft rotates the object in a plane perpendicular to the axis of the second shaft, and wherein an object connected to the second shaft is subjected to all four of tilting by movement of the tilting linkage, rotation in a plane perpendicular to the axis of the first shaft by rotation of the first shaft, rotation in a plane perpendicular to the axis of the second shaft by rotation of the second shaft, and linear displacement along the longitudinal axis of the boom.

16. The method according to claim 15, wherein the object is a panel and the predetermined position is an opening in the structure and the step of releasing the object includes releasing the panel in the opening.

17. The method according to claim 15, including providing a service box on the adjustment head, and remotely controlling al of the movements from the service box.

* * * * *